US006232717B1

(12) United States Patent
Oida et al.

(10) Patent No.: US 6,232,717 B1
(45) Date of Patent: May 15, 2001

(54) AC TYPE COLOR PLASMA DISPLAY PANEL

(75) Inventors: Osamu Oida; Takuo Shinohara, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/192,485

(22) Filed: Nov. 17, 1998

(51) Int. Cl.[7] ..... H01J 17/49

(52) U.S. Cl. ..... 313/586; 313/584; 313/587; 313/112

(58) Field of Search ..... 313/112, 586, 313/585, 584, 587; 345/41, 55

(56) References Cited

U.S. PATENT DOCUMENTS 5,838,105 * 11/1998 Motomo ..... 313/112 X
5,838,106 * 11/1998 Funada ..... 313/584 X
6,066,917 * 5/2000 Funada ..... 313/587

FOREIGN PATENT DOCUMENTS 8-111180 4/1996 (JP) .

* cited by examiner

*Primary Examiner*—Ashok Patel
(74) *Attorney, Agent, or Firm*—McGinn & Gibb, PLLC

(57) ABSTRACT

In an AC type surface discharge color plasma display panel which includes transparent electrodes (2) formed on a first substrate surface of a first substrate (1), bus electrodes (3) formed on the transparent electrodes, respectively, first, second, and third color filter layers (4R, 4G, and 4B), and a transparent dielectric layer (5) covering the transparent electrodes, the bus electrodes, and the color filter layers, each of the first, the second, and the third color filter layers and each of the bus electrodes are located offset from each other on the first substrate surface so as not to overlap each other and so as not to be brought into contact with each other. The transparent electrodes are substantially parallel to each other. The bus electrodes are substantially parallel to each other and to the transparent electrodes. The first, second, and third color filter layers perpendicularly intersect with the transparent electrodes and the bus electrodes and transparent to red light, green light, and blue light, respectively. Preferably, the color filter layers are brought into contact with the transparent electrodes and the first substrate. Alternatively, the color filter layers may be formed inside of the transparent dielectric layer.

7 Claims, 6 Drawing Sheets

AC TYPE COLOR PLASMA DISPLAY PANEL

BACKGROUND OF THE INVENTION

This invention relates to a color plasma display panel for use in an information display terminal or a flat panel television and, in particular, to a color plasma display panel which is high in contrast and excellent in color fidelity or color reproducibility.

A color plasma display panel (hereinafter abbreviated to a color PDP) is a display in which ultraviolet rays are produced by gas discharge to excite phosphors so that visible lights are emitted therefrom to perform a display operation. Depending upon a discharge mode, the color PDP is classified into an AC (alternating current) or a DC (direct current) type. The AC type is superior to the DC type in luminance, luminous efficiency, and lifetime.

Referring to FIGS. 1 through 3, a conventional reflection AC type surface discharge color PDP will be described.

As illustrated in the figures, the conventional color PDP comprises a transparent glass plate as a front substrate 1. The front substrate 1 is provided with a plurality of transparent electrodes 2 arranged in stripes. In FIG. 2, the transparent electrodes 2 extend in a direction perpendicular to the drawing sheet. Between adjacent ones of the transparent electrodes 2, an AC pulse voltage of several tens to several hundreds kilohertz (kHz) is applied to cause discharge which triggers a display operation.

In the reflection AC type surface discharge color PDP, it is required to avoid interception of the visible lights emitted from phosphor layers 9R, 9G, and 9B which will later be described. To this end, the transparent electrodes 2 typically comprise a transparent conductive film of tin oxide (SnO2) or indium tin oxide (ITO) deposited by a thin film technique such as sputtering.

However, the transparent conductive film mentioned above is high in sheet resistance. In case of a large panel or a high-definition panel, an electrode resistance will become as high as several tens kiloohms (kΩ) or more. This may result in insufficient pulse rise or voltage drop of the pulse voltage applied to the transparent electrodes 2. In this event, it is difficult to drive the color PDP. Taking the above into account, it is proposed to provide each of the transparent electrodes 2 with a bus electrode 3 comprising a multilayer thin film of chromium/copper/chromium, a metal thin film such as an aluminum thin film, or a metal thick film using a silver paste. A combination of each transparent electrode 2 and each bus electrode 3 forms a surface discharge electrode set 2H reduced in resistance by presence of the bus electrode 3.

On the surface discharge electrode sets 2H, color filter layers 4R, 4G, and 4B comprising fine powder pigments are formed in stripes to perpendicularly intersect with the surface discharge electrode sets 2H. Generally, the color filter layers 4R, 4G, and 4B are formed from selected materials having optical characteristics such that luminescent colors of the phosphor layers 9R, 9G, and 9B faced to the color filter layers 4R, 4G, and 4B are exclusively allowed to pass through the color filter layers 4R, 4G, and 4B, respectively. Furthermore, the color filter layers 4R, 4G, and 4B are coated with a transparent dielectric layer 5. The transparent dielectric layer 5 has a current limiting function specific to the AC type PDP. The current limiting function will hereinafter be explained. When two adjacent ones of the surface discharge electrode sets 2H are applied with the voltage, surface discharge is caused therebetween. As a result of the discharge, electric charges are stored in the transparent dielectric layer 5. When the sum of the voltage between the surface discharge electrode sets 2H and the voltage owing to the electric charges stored in the transparent dielectric layer 5 becomes smaller than a discharge maintaining voltage, the discharge is stopped.

In order to assure the dielectric strength and to facilitate the production, the transparent dielectric layer 5 is typically formed by preparing a paste mainly containing a low-melting-point glass, applying the paste by thick-film printing, and baking the paste at a high temperature not lower than a softening point of the glass so that the glass is subjected to reflowing. The transparent dielectric layer 5 thus obtained is flat and does not contain air bubbles. The transparent dielectric layer 5 has a thickness on the order between 20 and 40 microns.

Next, a protection layer 6 is formed to cover an entire surface of the transparent dielectric layer 5. The protection layer 6 comprises a MgO thin film formed by vapor deposition or sputtering or a Mgo film formed by printing or spraying. The protection layer 6 has a thickness on the order between 0.5 and 1 micron. The protection layer 6 serves to lower the discharge voltage and to prevent surface sputtering.

On the other hand, a rear substrate 10 is provided with a plurality of data electrodes 8 arranged in stripes to write display data. in FIG. 2, the data electrodes 8 extend in a direction parallel to the drawing sheet. The data electrodes 8 intersect with the surface discharge electrode sets 2H formed on the front substrate 1. As illustrated in FIG. 1, a plurality of barrier ribs 7 are formed typically by thick-film printing so as not to overlap the data electrodes 8 and to extend in parallel to the data electrodes 8. The barrier ribs 7 serve to avoid discharge error and optical crosstalk between neighboring discharge cells 11. The barrier ribs 7 are not illustrated in FIG. 2, Furthermore, the phosphor layers 9R, 9G, and 9B corresponding to the luminescent colors of red, green, and blue, respectively, are formed by applying three kinds of phosphors in three successive steps, one step for one color, to cover side walls of the barrier ribs 7 and the data electrodes 8. Since the phosphor layers 9R, 9G, and 9B are also formed on the side walls of the barrier ribs 7, phosphor coated areas are increased to achieve high luminance. The formation of the phosphor layers 9R, 9G, and 9B is typically carried out by screen printing.

Thereafter, the front substrate 1 and the rear substrate 10 are coupled face to face to each other with the barrier ribs 7 interposed therebetween in the manner such that the surface discharge electrode sets 2H and the data electrodes 8 perpendicularly intersect with each other. Then, an assembly of the front and the rear substrates 1 and 10 is sealed airtight. A dischargeable gas, such as a mixed gas of He, Ne, and Xe, is confined within the discharge cells 11 at a pressure on the order of 500 Torr.

In each discharge cell 11, a pair of the surface discharge electrode sets 2H are arranged each of which comprises one transparent electrode 2 and one bus electrode 3. In a gap between the surface discharge electrode sets 2H in each pair, the surface discharge occurs to produce plasma in each discharge cell 11. At this time, ultraviolet ray is produced to excite the phosphor layers 9R, 9G, and 9B so that the visible lights of red, green, and blue are produced therefrom Through the color filter layers 4R, 4G, and 4B formed on the front substrate 1, the visible lights are observed as display lights.

As described above, the surface discharge occurs between each pair of the surface discharge electrode sets 2H adjacent to each other. Herein, one and the other of the electrode sets 2H in each pair serve as a scanning electrode and a maintaining electrode, respectively. While the color PDP is actually driven, maintaining pulses are applied between the scanning electrode and the maintaining electrode. In order to cause writing discharge, an electric voltage is applied between the scanning electrode and the data electrode 8 to trigger opposed discharge. By the maintaining pulses subsequently applied, maintaining discharge is generated between the surface discharge electrode sets 2H.

Referring to FIGS. 4 and 5, a reflection AC type opposed discharge color PDP comprises a transparent glass plate as a front substrate 1 with a plurality of X electrodes 12 arranged in stripes. In FIG. 5, the X electrodes 12 extend in a direction perpendicular to the drawing sheet. On the other hand, a rear substrate 10 is provided with a plurality of Y electrodes 15 arranged in stripes.

Referring to FIG. 5, the Y electrodes 15 extend in a direction parallel to the drawing sheet. The X electrodes 12 and the Y electrodes 15 are covered by dielectric layers 5 and 14, respectively, to form capacitors characterizing the AC type color PDP. An AC pulse voltage of several tens to several hundreds kilohertz (kHz) is applied between the X electrodes 12 and the Y electrodes 15 to cause discharge which triggers a display operation. The condensers formed by the X electrodes 12, the Y electrodes 15, and the dielectric layers 5 and 14 have a function similar to the transparent dielectric layer 5 of the surface discharge type described above.

To produce the reflection AC opposed discharge color PDP, the X electrodes 12 are at first formed on the front substrate 1. The X electrodes 12 must be thin so as not to intercept visible lights emitted from phosphor layers 9R, 9G, and 9B. However, when the X electrodes 12 are thin, the resistance is increased. It is therefore required to use metal electrodes having a low resistance. Taking the above into account, the X electrodes 12 are formed by a multilayer thin film of chromium/copper/chromium, a metal thin film such as an aluminum thin film, or a metal thick film using a silver paste.

Next, black masks 13 are formed. In FIG. 4, the black masks 13 are formed to be perpendicular to the drawing sheet and to extend between the X electrodes 12 in parallel to the X electrodes 12. The black masks 13 are formed on the front substrate 1 in order to avoid the decrease in contrast due to white body colors of barrier ribs 7 and the phosphor layers 9R, 9G, and 9B formed on the rear substrate 10. The black masks 13 are formed by direct patterning according to thick-film printing. Alternatively, a photosensitive paste is applied on the front substrate 1 in a solid unpatterned manner and thereafter patterned via exposure and development.

Between the black masks 13, color filter layers 4R, 4G, and 4B are formed in stripes. Generally, the color filter layers 4R, 4G, and 4B are formed from selected materials having optical characteristics such that luminescent colors of the phosphor layers 9R, 9G, and 9B faced to the color filter layers 4R, 4G, and 4B are exclusively allowed to pass through the color filter layers 4R, 4G, and 4B, respectively. On the color filter layers 4R, 4G, and 4B, the transparent dielectric layer 5 and a protection layer 6 are sucessively formed. The purpose and the manner of forming these layers are similar to those described in conjunction with the AC type surface discharge color PDP and will not be described any longer.

On the other hand, the Y electrodes 15 are formed on the rear substrate 11 to perpendicularly intersect with the X electrodes 12 formed on the front substrate 1. In FIG. 4, the Y electrodes 15 extend in parallel to the drawing sheet. The Y electrodes 15 are formed in the manner similar to that mentioned in conjunction with the X electrodes 12. The dielectric layer 14 is formed on the Y electrodes 15. Unlike the transparent dielectric layer 5 formed on the front substrate 1, the dielectric layer 14 need not be transparent. Rather, the dielectric layer 14 is preferably white so as to efficiently reflect the visible lights emitted from the phosphor layers 9R, 9G, and 9B towards the front substrate 1. Like the transparent dielectric layer 5, the dielectric layer 14 is formed by preparing a paste mainly containing a low-melting-point glass, applying the paste by thick-film printing, and baking the paste at a high temperature not lower than a softening point of the glass so that the glass is subjected to reflowing. The dielectric layer 14 thus obtained is flat and does not contain air bubbles. The dielectric layer 14 has a thickness on the order between 15 and 30 microns.

A protection layer 16 is deposited on the dielectric layer 14 as a plurality of protection patterns arranged in stripes and perpendicularly intersecting with the Y electrodes 15. Referring to FIG. 5, the protection layer 16 is perpendicular to the drawing sheet. The protection layer 16 formed on the rear substrate 11 has a function similar to that of the protection layer 6 formed on the front substrate 1. In this opposed discharge type, all discharges, including writing discharge and maintaining discharge, are carried out between the front substrate 1 and the rear substrate 11. It is therefore necessary to form the protection layer 16 on the rear substrate 11 in addition to the protection layer 6 formed on the front substrate 1.

Next, the barrier ribs 7 are formed on the dielectric layer 14 between every adjacent ones of the protection patterns of the protection layer 16. The barrier ribs 7 are formed in stripes to perpendicularly intersect with the Y electrodes 15 and to extend in parallel to the protection patterns of the protection layer 16. In FIG. 4, the barrier ribs 7 are perpendicular to the drawing sheet. In case of the surface discharge color PDP, the discharge occurs between the surface discharge electrode sets 2H (FIG. 2). In contrast, in case of the opposed discharge type in FIG. 4, the discharge occurs between the X electrodes 12 on the front substrate 1 and the Y electrodes 15 on the rear substrate 11. It is noted here that a discharge start voltage and a discharge maintaining voltage widely differ depending upon a discharge gap. Therefore, in case of the surface discharge type, the distance between the transparent electrodes 2 adjacent to each other is very important. On the other hand, in case of the opposed discharge type, the height of the barrier ribs 7 is important. Therefore, the barrier ribs 7 are formed by multilayer thick-film printing or sandblasting.

A discharge cell 17 is defined by every two adjacent ones of the barrier ribs 7, the front substrate 1, and the rear substrate 11. In the discharge cells 17, the phosphor layers 9R, 9G, and 9B corresponding to luminescent colors of red, green, and blue, respectively, are formed by applying three kinds of phosphors in three successive steps, one step for one color. In order to increase the phosphor coated areas so as to achieve high luminance, the phosphor layers 9R, 9G, and 9B are formed also on the side walls of the barrier ribs 7. The phosphor layers 9R, 9G, and 9B are typically formed by screen printing. The phosphor layers 9R, 9G, and 9B must not cover the protection patterns of the protection layer 16 formed between the barrier ribs 7.

Thereafter, the front substrate 1 and the rear substrate 11 are coupled face to face to each other with the barrier ribs 7 interposed therebetween in the manner such that the X electrodes 12 and the Y electrodes 15 perpendicularly intersect with each other. Then, an assembly of the front and the rear substrates 1 and 11 is sealed airtight. A dischargeable gas is confined within the discharge cells 17.

Referring back to FIG. 2, each of the phosphor layers 9R, 9G, and 9B used in the color PDP comprises white powder having very high reflectivity. Thus, the phosphor layers 9R, 9G, and 9B have a white body color. When an external light such as an indoor or outdoor light is incident to the color PDP, the external light is partly absorbed at the upper portion of the barrier ribs and the bus electrodes. Typically, 30% to 50% of the light is reflected. As a result, the contrast is considerably degraded. In order to prevent the reflection of the external light so as to achieve a high-contrast display, it is proposed to cover a panel surface with an ND (Neutral Density) filter having a transmittance of 40 to 80%. In this case, however, the visible lights from the phosphor layers 9R, 9G, and 9B are partly intercepted to decrease the luminance of the color PDP.

In order to suppress the reflection of the external light while minimizing the decrease in luminance, it is proposed to use the color filter layers 4R, 4G, and 4B. Specifically, in correspondence to the luminescent colors of the discharge cells 17 of red, green, and blue, the color filter layers 4R, 4G, and 4B are formed on the front substrate 1 to pass the red light, the green light, and the blue light, respectively. With this structure, it is possible to simultaneously achieve high contrast and high color fidelity.

Generally, the color filter layers 4R, 4G, and 4B comprise fine powder pigments without containing glass frit. For example, the pigments exclusively allowing passage of the red light, the green light, and the blue light, respectively, may comprise following materials.

red: $Fe_2O_3$-based material green: $CoO—Al_2O_3—Cr_2O_3$ based material blue: $CoO—Al_2O_3$ based material Each of these pigments is mixed with resin and a solvent to form a paste. The paste is applied by printing. Thereafter, the solvent is evaporated. After drying, baking is carried out to remove the resin component. Then, on the color filter layers 4R, 4G, and 4B, the transparent dielectric layer 5 are formed by printing, drying, and baking. However, if the color filter layers 4R, 4G, and 4B are formed directly on the surface discharge electrode sets 2H, floating of the bus electrodes 3 occurs to result in open circuits or insufficient dielectric strength when the panel is formed. Such floating of the bus electrodes 3 occurs upon baking of the transparent dielectric layer 5 formed on the color filter layers 4R, 4G, and 4B. The reason is assumed as follows. The bus electrodes 3 formed on the transparent electrodes 2 are weak in bonding force with the transparent electrodes 2. This is because the transparent electrodes 2 are typically formed by depositing tin oxide or ITO according to the thin film technique as described above.

It is assumed that the bus electrodes 3 are formed by the thick film technique. In this event, the bus electrodes 3 after baking have a composition including a glass frit and a conductive metal. The bus electrodes 3 acquire their bonding force from the glass frit softened by baking to be tightly bonded to an underlying layer. However, if the underlying layer includes the transparent electrodes 2 formed by the thin film technique and containing no glass frit, the bonding force of the bus electrodes 3 to the transparent electrodes 2 is weakened even if the glass frit in the bus electrodes 3 is softened by baking.

Furthermore, each of the color filter layers 4R, 4G, and 4B mainly comprises the pigment without containing the glass frit. If the glass frit is mixed with the pigment to form the color filter layer, a light transmission characteristic is degraded, i.e., the luminance is reduced and the color fidelity is deteriorated. Thus, the color filter layers 4R, 4G, and 4B are reduced in performance by half. Taking the above into consideration, it is general that the color filter layers 4R, 4G, and 4B mainly contain the pigments without using the glass frit. When the transparent dielectric layer 5 containing the glass frit is formed on the color filter layers 4R, 4G, and 4B by applying and baking the paste, stress is produced because of difference in thermal expansion among the bus electrodes 3, the color filter layers 4R, 4G, and 4B, and the transparent dielectric layer 5. The stress is concentrated on the bus electrodes 3 weak in bonding force. This results in occurrence of floating of the bus electrodes 3.

As described above, the transparent dielectric layer 5 (the transparent dielectric layer 5 and the dielectric layer 14 in case of the opposed discharge type) has the current limiting (or controlling) function specific to the AC type PDP. The current limiting function greatly depends on the dielectric constant and the thickness of the transparent dielectric layer 5 (the transparent dielectric layer 5 and the dielectric layer 14 in case of the opposed discharge type). In case of the surface discharge type, capacitors are formed by the surface discharge electrode sets 2H and the transparent dielectric layer 5. (In case of the opposed discharge type, capacitors are formed by the X electrodes 12 and the transparent dielectric layer 5 and by the Y electrodes 15 and the dielectric layer 14.) If the color filter layers 4R, 4G, and 4B are formed between the surface discharge electrode sets 2H and the transparent dielectric layer 5 (or between the X electrodes 12 and the transparent dielectric layer 5), electrostatic capacitance is given by a serial combination of the transparent dielectric layer 5 and each of the color filter layers 4R, 4G, and 4B. It is noted here that the color filter layers 4R, 4G, and 4B comprise different materials exclusively allowing passage of the red light, the green light, and the blue light, respectively. As a result, the electrostatic capacitance differs among different colors. This brings about an in increase or a nonuniformity of the opposed discharge voltage.

Furthermore, the transparent electrode 2 in each surface discharge electrode set 2H is formed by the thin film technique such as sputtering and has a thickness between 1000 and 2000 angstroms. On the other hand, the bus electrode 3 has a thickness between 2 and 8 microns. Thus, the electro-static capacitance of the condenser formed by the surface discharge electrode set 2H and the transparent dielectric layer 5 is greatest on the bus electrode 3. When the color filter layers 4R, 4G, and 4B of the different materials corresponding to red, green, and blue are formed on the bus electrode 3, the electrostatic capacitance is different among red, green, and blue cells. This results in an increase or a nonuniformity of the opposed discharge voltage between the scanning electrode and the data electrode 8.

On the other hand, Japanese Unexamined Patent Publication (JP-A) 8-111180 (111180/1996) discloses a DC type color PDP in which each of color filter layers 42*a* and 42*b* is smaller in area than a region surrounded by black masks 43, as illustrated in FIG. 6. On a front substrate 41, the color filter layers 42*a* and 42*b* are formed except a portion where a cathode 45 is present. Referring to FIG. 6, a reference numeral 44 represents a window. On a rear substrate 46, a display anode 47, a dielectric layer 48, and a phosphor layer 49 are successively formed. Between the black masks 43 and the dielectric layer 48, a plurality of barrier ribs 50 are formed. A display cell 51 is defined as a space surrounded by side walls of adjacent ones of the barrier ribs 50.

With the above-mentioned structure, optimum luminance and optimum contrast can be obtained by narrowing the areas of the color filter layers 42*a* and 42*b*.

However, the above-mentioned prior art is related to the DC type color PDP. In case of the DC type color PDP, DC discharge occurs between the cathode 45 and the anode 47. If the color filter layer 42*a* is formed on the cathode 45, no discharge occurs because the color filter layer 42*a* is not conductive. AS a result, a display operation can not be carried out. In this connection, the color filter layers 42*a* and 42*b* are formed in those regions except a portion where the cathode 45 is present. Consideration will be made about application of this technique to the AC type color PDP. This technique suggests to narrow each of the color filter layers 42*a* and 42*b* in area than the region surrounded by the black masks 43 in view of the luminance and the contrast. In case of the AC type color PDP, discharge occurs even if the color filter layer is formed on the electrodes. Thus, no influence is given to the contrast and the luminance even if the color filter layer overlaps the electrodes. Taking into account easiness in production, it is preferred that the color filter layer is also formed on the electrodes.

However, if this PDP is actually produced, the floating of the electrodes occurs as described above to result in open circuits and insufficient dielectric strength. In this event, the PDP can not operate. Even if no open circuit occurs, incoincidence in electrostatic capacitance occurs due to difference in filter material for red, green, and blue. This results in color dependency of the voltage of the opposed discharge occurring between the scanning electrode and the data electrode 8 upon driving the PDP. Consequently, driving is difficult or requires a complicated driving circuit. The above-mentioned prior art does not suggest any approach to solve these problems.

As described above, the AC type color PDP with the color filter layers is disadvantageous. Specifically, if the color filter layers are formed on the surface discharge electrode sets each comprising the transparent electrode and the bus electrode, floating of the bus electrodes occurs, upon baking the transparent dielectric layer formed on the color filter layers, at those portions where the bus electrodes of metal and the color filter layers are brought into contact. This may result in open circuits or insufficient dielectric strength when the PDP is manufactured. The reason is as follows.

The bus electrodes formed on the transparent electrodes are weak in bonding force with the transparent electrodes. In addition, each of the color filter layers mainly contains the pigment without the glass frit. When the transparent dielectric layer containing the glass frit is formed on the color filter layers by applying and baking the paste, thermal expansion differs among the bus electrodes, the color filter layers, and the transparent dielectric layer. In this event, the stress is produced and concentrated on the bus electrodes weak in bonding force. This results in floating of the bus electrodes.

The transparent dielectric layer (or dielectric layer) has the current limiting (or controlling) function specific to the AC type color PDP. This function is achieved by forming the condensers by the surface discharge electrode sets (or the X electrodes) and the transparent dielectric layer or by the Y electrode and the dielectric layer. However, if the color filter layers are formed between the surface discharge electrode sets and the transparent dielectric layer, between the X electrodes and the transparent dielectric layer, or within the transparent dielectric layer, the electrostatic capacitance of the condenser is given by a serial combination of the transparent dielectric layer and each of the color filter layers. However, the color filter layers transparent to the red light, the green light, and the blue light, respectively, are formed by different materials. As a result, the electrostatic capacitance differs among different colors. This brings about an increase or a nonuniformity of the opposed discharge voltage.

Furthermore, the transparent electrode in each surface discharge electrode set has a thickness between 1000 and 2000 angstroms while the bus electrode has a thickness between 2 and 8 microns. Thus, on the bus electrode, the transparent dielectric layer is thinner by the height of the bus electrode than on the transparent electrode. As a result, the portion where the bus electrode exists has a greatest electrostatic capacitance and greatly affects the discharge characterstic of the opposed discharge. Therefore, when the color filter layers are formed between the surface discharge electrode set and the transparent dielectric layer or within the transparent dielectric layer, the electrostatic capacitance is different among different colors. This results in an increase or a nonuniformity of the opposed discharge voltage.

SUMMARY OF THE INVENTION

It is an object of this invention to provide a color plasma display panel capable of suppressing interaction between a color filter layer and a metal electrode and stably driving a display operation throughout an entire surface of the panel.

Other objects of this invention will become clear as the description proceeds.

An AC type surface discharge color plasma display panel to which this invention is applicable comprises: a first substrate (1) having a first substrate surface; a pair of surface discharge electrode sets (2H) each of which comprises a transparent electrode (2) formed on the first substrate surface and a bus electrode (3) formed on a part of the transparent electrode, the transparent electrodes being substantially parallel to each other, the bus electrodes being substantially parallel to each other and to the transparent electrodes; first, second, and third color filter layers (4R, 4G, and 4B) perpendicularly intersecting with the surface discharge electrode sets and transparent to red light, green light, and blue light, respectively; a transparent dielectric layer (5) covering the surface discharge electrode sets and the color filter layers; a second substrate (10) having a second substrate surface opposite to the first substrate surface; first, second, and third data electrodes (8) formed on the second substrate surface in correspondence to the first, the second, and the third color filter layers; first, second, and third phosphor layers (9R, 9G, and 9B) formed on the first, the second, and the third data electrodes, respectively; and barrier ribs (7) defining first, second, and third discharge spaces (11) between the first, the second, and the third phosphor layers and the first, the second, and the third color filter layers. The first, the second, and the third phosphor layers are excited by ultraviolet rays produced by gas discharge in the first, the second, and the third discharge spaces to emit red light, green light, and blue light, respectively.

According to this invention, each of the first, the second, and the third color filter layers and each of the bus electrodes are located offset from each other on the first substrate surface so as not to overlap each other and so as not to be brought into contact with each other.

An AC type opposed discharge color plasma display panel to which this invention is applicable comprises: a first substrate (1) having a first substrate surface; first, second, and third X electrodes (12) which are formed on the first substrate surface and are substantially parallel to each other; first, second, and third color filter layers (4R, 4G, and 4B) which are formed in correspondence to the first, the second, and the third X electrodes and are transparent to red light, green light, and blue light, respectively; a transparent dielectric layer (5) covering the X electrodes and the color filter layers; a second substrate (10) having a second substrate surface opposite to the first substrate surface; a plurality of Y electrodes (15) formed on the second substrate surface and perpendicular to the x electrodes; a dielectric layer (14) covering the Y electrodes; first, second, and third phosphor layers (9R, 9G, and 9B) formed on the dielectric layer; and barrier ribs (7) defining first, second, and third discharge spaces (17) between the first, the second, and the third phosphor layers and the first, the second, and the third color filter layers. The first, the second, and the third phosphor layers are excited by ultraviolet rays produced by gas discharge in the first, the second, and the third discharge spaces to emit red light, green light, and blue light, respectively.

According to this invention, the first, the second, and the third color filter layers extend in parallel to the first, the second, and the third X electrodes and are located offset from the first, the second, and the third X electrodes on the first substrate surface so as not to overlap the first, the second, and the third X electrodes and so as not to be brought into contact with the first, the second, and the third X electrodes.

In the AC type surface discharge color plasma display panel, the color filter layers are not brought in contact with the bus electrodes. Therefore, the floating of the bus electrodes are prevented upon baking of the transparent dielectric layer. As a result, it is possible to suppress the occurrence of open circuits or insufficient dielectric strength.

Whether the color filter layers are formed to be coplanar with the bus electrodes (or X electrodes) or formed within the transparent dielectric layer, no more than the transparent dielectric layer and the protection layer are present on the bus electrodes (or the X electrodes). As a result, the amount of the electric charges stored on the surface of the transparent dielectric layer formed on the bus electrodes (or the X electrodes) do not depend on the materials of the color filter layers. Therefore, it is possible to avoid a nonuniformity in voltage due to the color filter layers transparent to the red light, the green light, and the blue light, respectively, so that the discharge voltage is stabilized throughout an entire surface of the panel.

DESCRIPTION OF THE PREFERRED EMBODIMENTS

Figure 1:
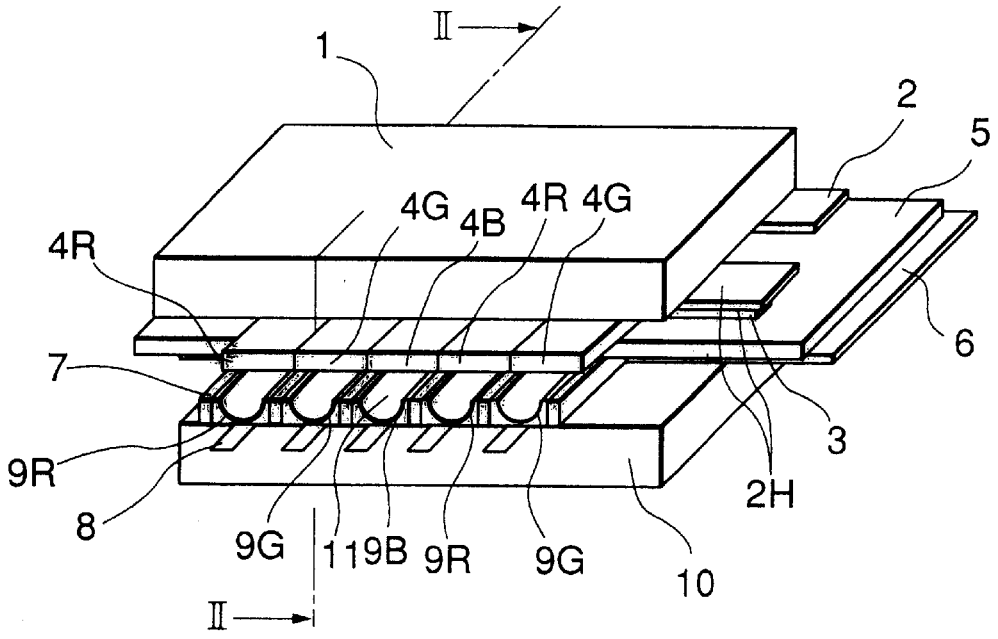
FIG. 1 PRIOR ART
FIG. 1 is a perspective view of a conventional reflection AC type surface discharge color plasma display panel.

Now, description will be made about several preferred embodiments of this invention with. reference to the drawing.

Figure 7:
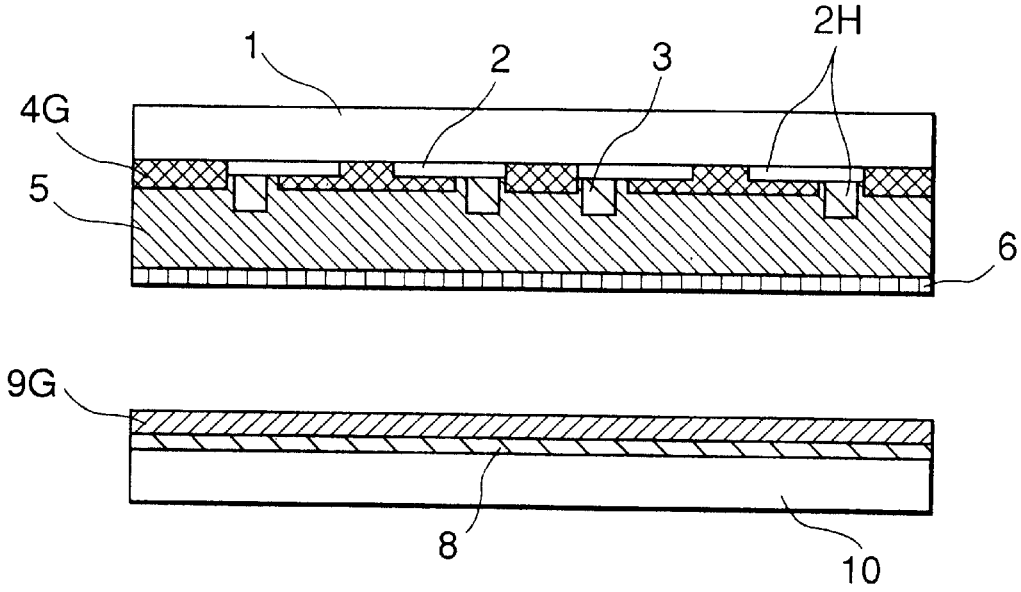
FIG. 7 is a sectional view of a color plasma display panel according to a first embodiment of this invention.
Figure 8:
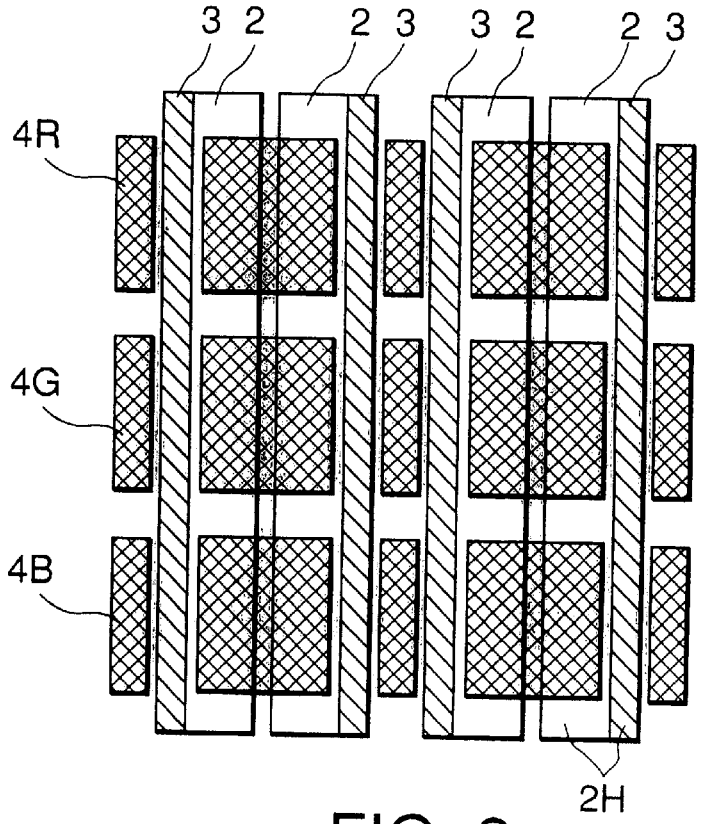
FIG. 8 is a view for use in describing a location relationship between color filter layers and bus electrodes of the panel of FIG. 7 when the panel is seen from an upper side of FIG. 7.

Referring to FIGS. 7 and 8, a color PDP according to a first embodiment of this invention is of a surface discharge AC type.

As illustrated in the figures, the color PDP comprises a front substrate (glass substrate) 1 as a first substrate. The front substrate 1 is provided with a plurality of surface discharge electrode sets 2H each of which comprises a transparent electrode 2 and a bus electrode 3, color filter layers 4R, 4G, and 4B perpendicularly intersecting with the surface discharge electrode sets 2H and transparent to red light, green light, and blue light, respectively, a transparent dielectric layer 5, and a protection layer 6 covering the transparent dielectric layer 5.

The color PDP further comprises a rear substrate (glass substrate) 10 as a second substrate. The rear substrate 10 is provided with a plurality of data electrodes 8, barrier ribs 7 (see FIG. 1) to define discharge spaces, and phosphor layers 9R, 9G, and 9B excited by ultraviolet ray to emit red light, green light, and blue light, respectively.

Figure 2:
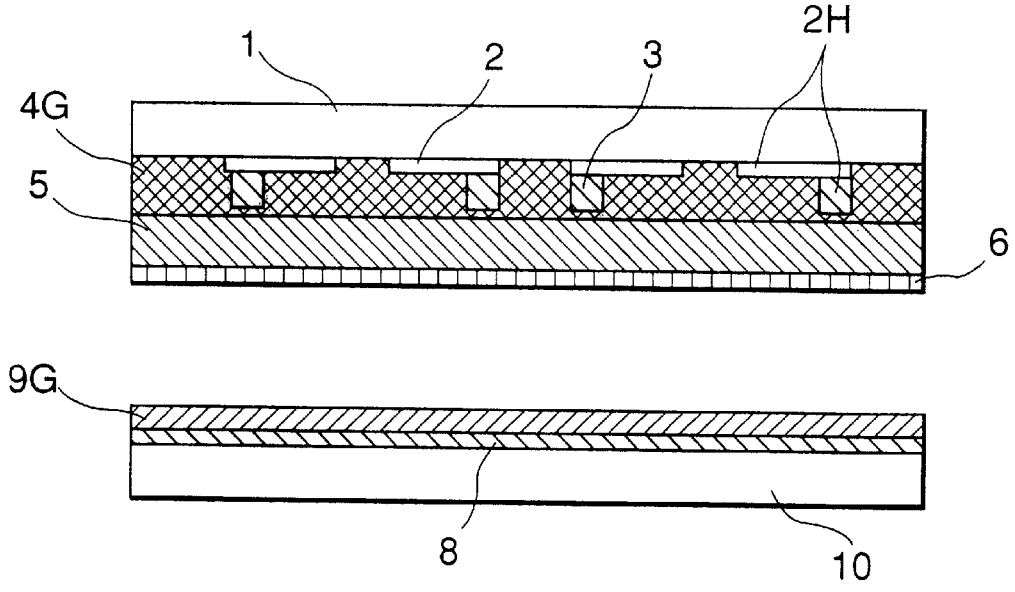
FIG. 2 PRIOR ART
FIG. 2 is a sectional view taken along a line II—II in FIG. 1.
Figure 3:
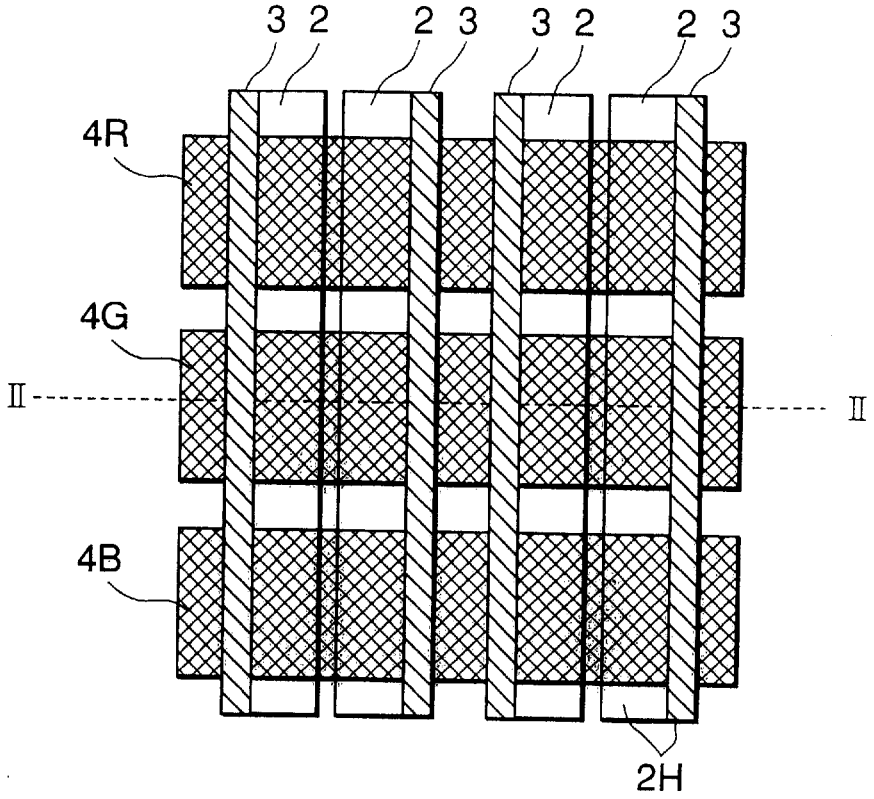
FIG. 3 PRIOR ART
FIG. 3 is a view for use in describing a location relationship between color filter layers and bus electrodes of the panel of FIG. 2 when the panel is seen from an upper side of FIG. 2.

The color filter layers 4R, 4G, and 4B and the bus electrodes 3 on the front substrate 1 are located offset from each other so as not to overlap each other. The color filter layers 4R, 4G, and 4B are brought into contact with the transparent electrodes 2 and the front substrate 1, In the manner similar to that described in conjunction with FIGS. 1 and 2, the data electrodes 8, the barrier ribs 7 (not shown), and the phosphor layers 9R, 9G, and 9B are successively formed on the rear substrate 10. Each of discharge cells 11 (see FIG. 1) for obtaining luminescent colors is formed by one of the data electrodes 8 and a pair of the surface discharge electrode sets 2H formed on the front substrate 1 and faced to the data electrodes 8 with the barrier ribs 7 interposed therebetween.

The color PDP of the first embodiment is manufactured in the following manner. At first, a transparent conductive film is deposited on the front substrate 1 throughout its entire surface in a solid unpatterned manner. The transparent conductive film may be a tin oxide ($SnO_2$) film or an indium tin oxide (ITO) film. In this embodiment, the ITO film is used. The deposition may be carried out by sputtering, CVD, or printing using a paste. In this embodiment, the transparent conductive file is deposited by sputtering to the thickness between 1000 and 2000 angstroms. After the transparent conductive film is deposited as described above, a resist is applied and subjected to drying, exposure, and development. Thereafter, the transparent conductive film is etched in electrode patterns. Thus, the transparent electrodes 2 are formed.

Then, the bus electrodes 3 having a low resistance are formed because the transparent electrodes 2 have a high resistance as described in conjunction with the prior art. The bus electrodes 3 may be made of a material such as chromium/copper/chromium, aluminum, or silver. In this embodiment, silver is used. The bus electrodes 3 may be formed by sputtering as a thin film technique or printing as a thick film technique. In this embodiment, the bus electrodes 3 are formed by printing because silver is used. The bus electrodes 3 comprising a silver thick film can achieve a desired line resistance (not greater than several hundreds ohms (Ω)). The printing using a silver paste can be performed at a baking temperature not higher than 600° C. so that direct patterning is possible. Thus, the formation of the bus electrodes 3 is very easy. In addition, the bus electrodes 3 comprising the silver thick film is advantageous in cost. The silver paste is prepared by preparing a mixture of silver powder and glass powder, adding an organic solvent and resin to the mixture, and blending them into the paste.

After electrode patterns are formed, baking is carried out at 500–600° C. so that the organic solvent and resin in the paste are burn out and no longer remain in the paste. After the baking, the bus electrodes 2 have a thickness of about 6 microns.

After the bus electrodes 3 are formed, the color filter layers 4R, 4G, and 4B are formed by printing. At first, a red particulate pigment mainly containing iron oxide is mixed with a binder and a solvent to form a paste. The paste is printed in stripes. In order that the color filter layer 4R in stripes is not formed on the bus electrodes 3, a screen pattern is preliminarily formed in those portions where the bus electrodes 3 are located. After printing, the solvent is evaporated and dried at about 150° C. to form a red pigment pattern.

Next, a green particulate pigment mainly containing cobalt oxide, chromium oxide, and aluminum oxide is mixed with a binder and a solvent to form a paste. The paste is printed in stripes next to and in parallel to the red pigment pattern. After printing, the paste is dried to form a green pigment pattern. Finally, a blue particulate pigment mainly containing cobalt oxide and aluminum oxide is mixed with a binder and a solvent to form a paste. The paste is printed in stripes next to and in parallel to the green pigment pattern. After printing, the paste is dried to form a green pigment pattern. Like the red pigment pattern, the green and the blue pigment patterns are not formed on the bus electrodes 3. Thus, a region corresponding to a display portion is entirely covered with the three pigment patterns via the above-mentioned three printing steps. Thereafter, baking is carried out at 500–600° C. After the baking, each of the color filter layers has a thickness of about 2 microns. Each of the color filter layers is very dense and compact because each of the inorganic pigments has a very small particle size on the order of 0.01–0.05 micron.

Subsequently, a paste of a low-melting-point glass is screen printed and baked at a temperature between 500 and 600° C. to form the transparent dielectric layer 5. After the baking, the transparent dielectric layer 5 has a thickness of about 30 microns. Then, the protection layer 6 of MgO is formed to cover an entire surface of the transparent dielectric layer 5. The protection layer 6 is formed by vapor deposition to a thickness of 0.5–1 micron.

The front substrate 1 with the various layers deposited thereon as mentioned above is coupled with the rear substrate 10 to form the color PDP. Upon the coupling, the front and the rear substrates 1 and 10 are registered so that the color filter layers 4R, 4G, and 4B formed on the front substrate 1 transmit luminescent colors of the phosphor layers 9R, 9G, and 9B formed on the rear substrate 10, respectively.

Experimentally, ten samples of the color PDP were prepared in the above-mentioned manner. In addition, thirty samples of the conventional color PDP were prepared for the sake of comparison. These samples were tested for open-circuit frequency. The result is shown in Table 1.

TABLE 1

| | OPEN-CIRCUIT FREQUENCY OF BUS ELECTRODES (%) | | |
|---|---|---|---|
| | RED FILTER PORTION | GREEN FILTER PORTION | BLUE FILTER PORTION |
| CONVENTIONAL PDP | 10.5 | 19.8 | 4.8 |
| PDP OF THIS INVENTION | 0 | 0 | 0 |

It is noted here that the bus electrodes 3 per each color PDP have a total length of about 1 km. Both the conventional color PDP and the color PDP of this invention had a reflectivity of about 15%. By provision of the color filter layers 4R, 4G, and 4B, high contrast and high color fidelity are achieved. Specifically, as seen from a display surface, the decrease in contrast due to the white body color of the phosphor layers 9R, 9G, and 9B is prevented by the color filter layers 4R, 4G, and 4B. In addition, lights produced by the discharge except the ultraviolet ray are led out of the color PDP to avoid degradation of luminescent colors of the phosphor layers 9R, 9G, and 9B. The decrease in contrast is affected by those regions where the surfaces of the phosphor layers 9R, 9G, and 9B are seen from the display surface.

On the other hand, the degradation in color fidelity is affected by those regions where the visible lights emitted from the phosphor layers 9R, 9G, and 9B pass through the front substrate 1. Specifically, in those portions where the bus electrodes 3 are formed, the body color of the phosphor layers 9R, 9G, and 9B is not seen from the display surface. In addition, the lights never pass through the bus electrodes 3 to be emitted outward. Thus, when the color filter layers 4R, 4G, and 4B are formed in areas where the bus electrodes 3 are not present, the contrast and the color fidelity are not influenced at all.

For each of a color PDR without the color filter layers 4R, 4G, and 4B, the conventional color PDP with the color filter layers 4R, 4G, and 4B, and the color PDP of this invention, the discharge voltage was measured. The result of measurement is shown in Table 2. It is understood from Table 2 that the color PDP of this invention is uniform in discharge voltage irrespective of the colors passing through the color filter layers.

TABLE 2

| | PLANE DISCHAGE VOLTAGE (V) | | | | | |
|---|---|---|---|---|---|---|
| | START VOLTAGE | | | MINIMUM MAINTAINING VOLTAGE | | |
| | R | G | B | R | G | B |
| COLOR PDP WITHOUT COLOR FILTER LAYERS | 195 | 194 | 195 | 170 | 169 | 170 |
| CONVENTIONAL COLOR PDP WITH COLOR FILTER LAYERS | 205 | 212 | 210 | 192 | 199 | 199 |
| COLOR PDP OF THIS INVENTION | 197 | 196 | 197 | 173 | 172 | 173 |

Summarizing in FIGS. 7 and 8, an AC type surface discharge color plasma display panel according to the first embodiment of this invention includes: a first substrate (1) having a first substrate surface; a pair of surface discharge electrode sets (2H) each of which includes a transparent electrode (2) formed on the first substrate surface and a bus electrode (3) formed on a part of the transparent electrode, the transparent electrodes being substantially parallel to each other, the bus electrodes being substantially parallel to each other and to the transparent electrodes; first, second, and third color filter layers (4R, 4G, and 4B) perpendicularly intersecting with the surface discharge electrode sets and transparent to red light, green light, and blue light, respectively; a transparent dielectric layer (5) covering the surface discharge electrode sets and the color filter layers; a second substrate (10) having a second substrate surface opposite to the first substrate surface; first, second, and third data electrodes (8) formed on the second substrate surface in correspondence to the first, the second, and the third color filter layers; first, second, and third phosphor layers (9R, 9G, and 9B) formed on the first, the second, and the third data electrodes, respectively; and barrier ribs (7) defining first, second, and third discharge spaces (11 of FIG. 1) between the first, the second, and the third phosphor layers and the first, the second, and the third color filter layers. The first, the second, and the third phosphor layers are excited by ultraviolet rays produced by gas discharge in the first, the second, and the third discharge spaces to emit red light, green light, and blue light, respectively.

In the AC type surface discharge color plasma display panel, each of the first, the second, and the third color filter layers and each of the bus electrodes are located offset from each other on the first substrate surface so as not to overlap each other and so as not to be brought into contact with each other.

More specifically, in the AC type surface discharge color plasma display panel, the color filter layers are brought into contact with the transparent electrodes and the first substrate.

Figure 9:
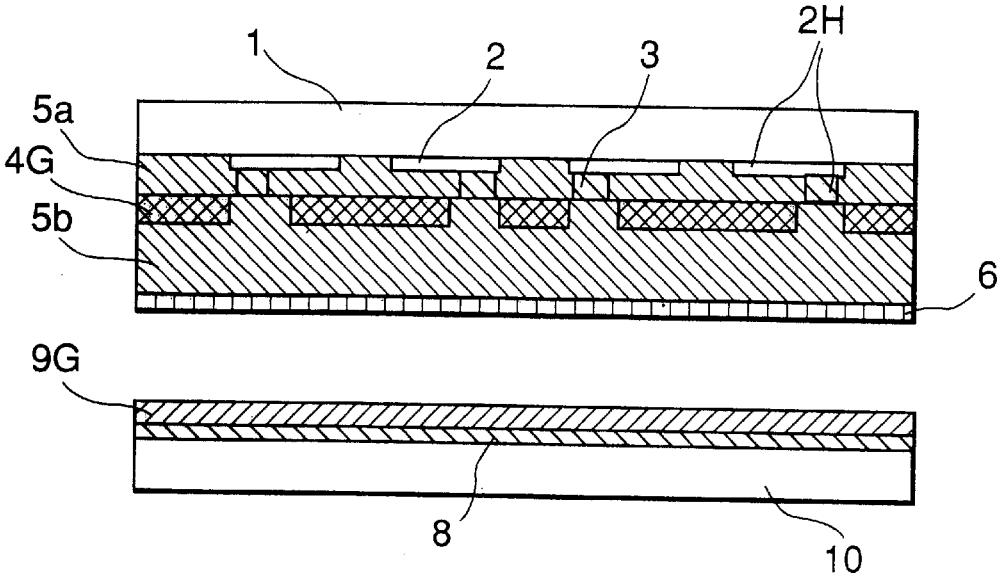
FIG. 9 is a sectional view of a color plasma display panel according to a second embodiment of this invention.
Figure 10:
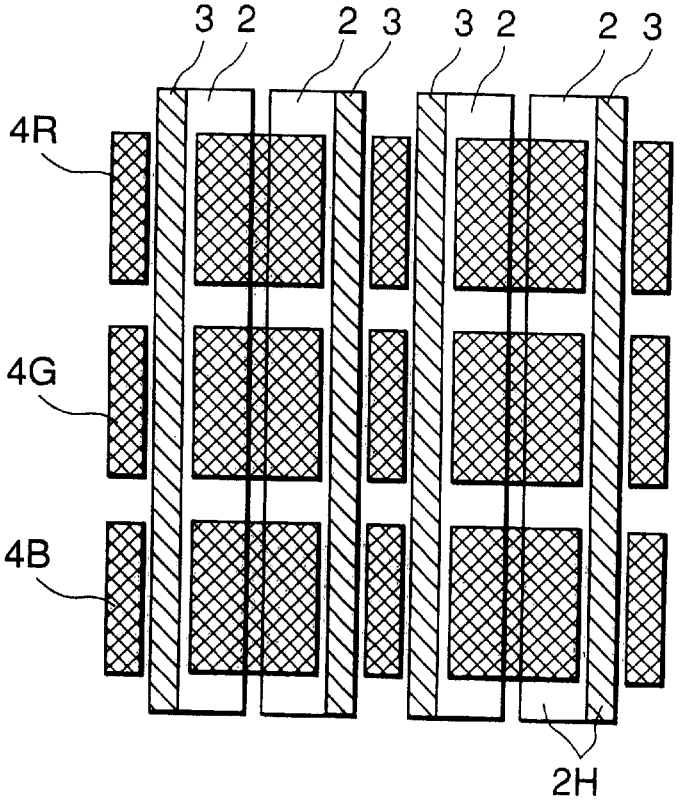
FIG. 10 is a view for use in describing a location relationship between color filter layers and bus electrodes of the panel of FIG. 9 when the panel is seen from an upper side of FIG. 9.

Referring to FIGS. 9 and 10, a surface discharge AC type color PDP according to a second embodiment of this invention is different from the first embodiment in that color filter layers 4R, 4C, and 4B are formed within transparent dielectric layers 5*a* and 5*b*.

At first, a plurality of surface discharge electrode sets 2H each of which comprises a transparent electrode 2 and a bus electrode 3 are formed on a front substrate 1 in the manner similar to that described in conjunction with the first embodiment.

Next, the transparent dielectric layer 5*a* is formed to cover the surface discharge electrode sets 2H. Specifically, a paste of a low-melting-point glass is applied by screen printing and baked at a temperature between 500 and 600° C. After baking, the transparent dielectric layer 5*a* has a thickness of about 10 microns.

On the transparent dielectric layer 5*a*, the color filter layers 4R, 4G, and 4B are formed. The formation of the color filter layers 4R, 4G, and 4B may be performed by PR using a photosensitive pigment paste or by direct printing. In this embodiment, the direct printing is used. The formation process is similar to the first embodiment and will not be described any longer. In order that the color filter layers 4R, 4G, and 4B axe not formed on the bus electrodes 3, a screen pattern is preliminarily formed on the location of the bus electrodes 3.

On the transparent dielectric layer 5*a*, a paste of a low-melting-point glass is applied by screen printing and baked at a temperature between 500 and 600° C. to form the transparent dielectric layer 5*b*. After the baking, the transparent dielectric layer 5*b* has a thickness of about 20 microns. Thereafter, a protection layer 6 of MgO is formed to cover an entire surface of the transparent dielectric layer 5*b*. The protection layer 6 is formed by vapor deposition to a thickness of 0.5–1 micron.

On a rear substrate 10, data electrodes 8, barrier ribs 7, and phosphor layers 9R, 9G, and 9B are successively formed in the manner similar to that described in conjunction with the conventional color PDP.

The front substrate 1 and the rear substrate 10 are coupled to each other to form the color PDP. Upon the coupling, the front and the rear substrates 1 and 10 are registered so that the color filter layers 4R, 4G, and 4B formed on the front substrate 1 transmit luminescent colors of the phosphor layers 9R, 9G, and 9B formed on the rear substrate 10, respectively.

When the color PDP is driven, open circuits of the electrodes do not occur because the color filter layers 4R, 4G, and 4B are forward within the transparent dielectric layer 5*b*. Since the color filter layers 4R, 4G, and 4B are not formed on the bus electrodes 3, each of red, green, and blue writing voltages is uniform throughout an entire surface of the color PDP.

Figure 11:
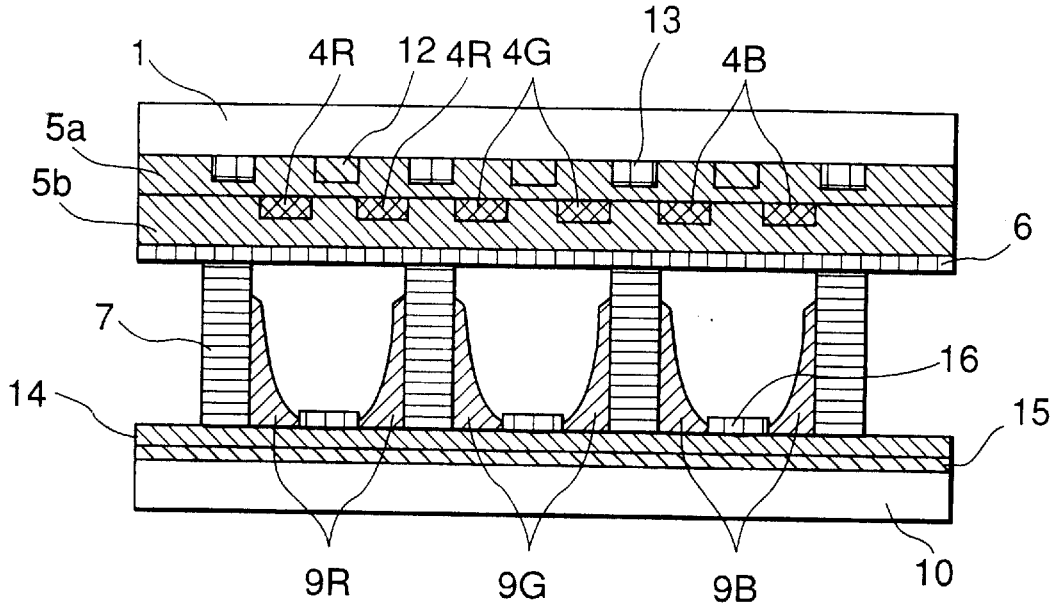
FIG. 11 is a sectional view of a color plasma display panel according to a third embodiment of this invention.
Figure 12:
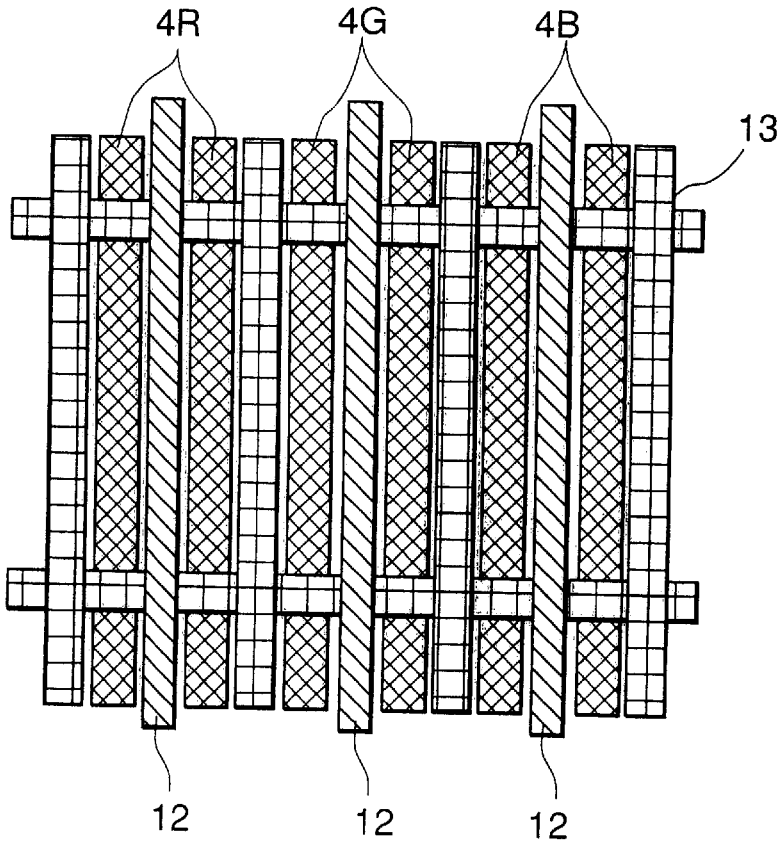
FIG. 12 is a view for use in describing a location relationship between color filter layers and X electrodes of the panel of FIG. 11 when the panel is seen from an upper side of FIG. 11.

Referring to FIGS. 11 and 12, an opposed discharge AC type color PDP according to a third embodiment of this invention has color filter layers 4R, 4G, and 4B formed within transparent dielectric layers 5*a* and 5*b*.

As illustrated in the figures, the color PDP of the third embodiment comprises a front substrate 1 as a first substrate. The front substrate 1 is provided with a plurality of X electrodes 12, the color filter layers 4R, 4G, and 4B transparent to red, green, and blue lights, respectively, the transparent dielectric layers 5*a* and 5*b*, and a protection layer 6 covering the transparent dielectric layers 5*a* and 5*b*.

The color PDP further comprises a rear substrate 10 as a second substrate. The rear substrate 10 is provided with a plurality of Y electrodes 15, a dielectric layer 14 covering the Y electrodes 15, barrier ribs 7 (see FIG. 1) formed in stripes on the dielectric layer 14 to perpendicularly intersect with the Y electrodes 15, phosphor layers 9R, 9G, and 9B formed between the barrier ribs 7 and excited by ultraviolet ray to emit red light, green light, and blue light, respectively, and a protection layer 16 formed in stripes at approximate centers between the barrier ribs 7 to extend in parallel to the barrier ribs 7.

The front substrate 1 and the rear substrate 10 are bonded to each other in the manner such that the X electrodes 12 formed on the front substrate 1 and the Y electrodes 15 formed on the rear substrate 10 perpendicularly intersect with each other. The color filter layers 4R, 4G, and 4B on the front substrate 1 extend in parallel to the X electrodes 12 and are located offset from the X electrodes 12 so as not to overlap the X electrodes 12.

The color filter layers 4R, 4G, and 4B may be formed on the glass substrate 1, although the color filter layers 4R, 4G, and 4B are formed within the transparent dielectric layers 5*a* and 5*b* deposited on the front substrate 1, as illustrated in FIG. 11.

The color PDP of the third embodiment is manufactured in the following manner. At first, the X electrodes 12 are formed on the front substrate (glass substrate) 1. Since the X electrodes 12 are formed on the front substrate 1 at the side of the display surface, the electrode width must be small. In this connection, a low-resistance metal is used.

The X electrodes 12 may be made of a material such as chromium/copper/chromium, aluminum, or silver. In this embodiment, silver is used. The X electrodes 12 may be formed by sputtering as a thin film technique or printing as a thick film technique. In this embodiment, printing as the thick film technique is used because silver is used. Herein, the reason of use of a silver thick film as the X electrodes 12 and the manner of forming the X electrodes 12 are similar to those described in conjunction with the bus electrodes 3 in the first embodiment and are not described any longer.

Next, a black mask 13 is formed. It is noted that the phosphor layers 9R, 9G, and 9B formed on the rear substrate 10 have a white body color. In order to prevent the decrease in contrast due to the white body color, the black mask 13 is formed at the side of the front substrate 1. The formation is carried out by thick-film printing.

Specifically, glass powder with a black pigment added thereto is mixed with an organic solvent and a resin component to form a paste. The paste is printed and dried to evaporate the organic solvent. Thereafter, the black mask 13 is baked at a temperature between 500 and 600° C. to burn out the resin component contained therein. In this baking, the glass component in the black mask 13 is once softened to obtain sufficient bonding force with the front substrate 1. After the black mask 13 is formed, the transparent dielectric layer 5*a* is formed. Specifically, a paste of a low-melting-point glass is applied by screen printing and baked at a temperature between 500 and 600° C.

After the transparent dielectric layer 5*a* is formed, the color filter layers 4R, 4G, and 4B are formed by printing. At first, a red particulate pigment mainly containing iron oxide is mixed with resin and a solvent to form a paste. The paste is applied in parallel to the X electrodes 12 and at both sides of the X electrodes 12. In order that the paste does not overlap the X electrodes 12 as seen from the display surface, a screen pattern is preliminarily formed. Thus, the paste is placed between the X electrodes 12 and the black mask 13 as seen from the display surface. The paste is dried to evaporate the solvent. Thus, a red pigment pattern is formed.

Next, a green particulate pigment mainly containing cobalt oxide, chromium oxide, and aluminum oxide is mixed with a binder and a solvent to form a paste, In the manner similar to that of the red pigment, the paste is printed in stripes next to and in parallel to the red pigment pattern. After printing, the paste is dried to form a green pigment pattern. Finally, a blue particulate pigment mainly containing cobalt oxide and aluminum oxide is mixed with a binder and a solvent to form a paste. The paste is printed in stripes next to and in parallel to the green pigment pattern. After printing, the paste is dried to form a green pigment pattern. Like the red pigment pattern, the green and the blue pigment patterns are not formed on the bus electrodes 3. Thus, a region corresponding to a display portion is entirely covered with the three pigment patterns via the above-mentioned three printing steps. Thereafter, baking is carried out at 500–600° C. After the baking, each of the color filter layers has a thickness of about 2 microns. Each of the color filter layers is very dense and compact because each of the inorganic pigments has a very small particle size on the order of 0.01–0.05 micron.

Thereafter, the transparent dielectric layer 5*b* is formed on the color filter layers 4R, 4G, and 4B in the manner similar to that described in conjunction with the transparent dielectric layer 5*a*. Finally, the protection layer 6 of Mgo is formed to cover the transparent dielectric layer 5*b*. The protection layer 6 is formed by vapor deposition to a thickness of 0.5–1 micron.

On the rear substrate 10, the Y electrodes 15 are at first formed. In order to achieve a low resistance, the Y electrodes 15 are formed by the use of silver and by printing as the thick-film technique in the manner similar to the X electrodes 12. The formation is similar to that described in conjunction with the bus electrodes 3 of the first embodiment and will not be described any longer.

Then, the dielectric layer 14 is formed on the Y electrodes 15. The transparent dielectric layers 5*a* and 5*b* formed on the front substrate 1 must be transparent to pass the visible lights emitted from the phosphor layers 9R, 9G, and 9B. On the other hand, the dielectric layer 14 formed on the rear substrate 10 is required to reflect the visible lights emitted from the phosphor layers 9R, 9G, and 9B towards the front substrate 1. In this connection, the dielectric layer 14 is a white layer. The white dielectric layer 14 is formed by a material similar to that of the transparent dielectric layer 5*a* except that 5–20 wt % $TiO_2$ is contained. The manner of forming the dielectric layer 14 is similar to that described in conjunction with the transparent dielectric layer 5*a* and will not be described any longer.

On the dielectric layer 14, the protection layer of MgO is formed. Specifically, an MgO paste is applied by printing in stripes to perpendicularly intersect with the Y electrodes 15. After the protection layer 16 is formed, the barrier ribs 7 are formed in parallel to the protection layer 16 so as not to overlap the protection layer 16. The barrier ribs 7 may be formed by multi-layer thick-film printing or sand-blasting. Since the sand-blasting may cause a damage in the protection layer 16, the multi-layer thick-film printing is adopted. Specifically, a paste material of the barrier ribs 7 are directly printed by the use of a screen pattern and dried to evaporate a solvent. On a resultant layer, the paste material is printed and dried again. This step is repeated about 10 times to achieve a desired height of the barrier ribs 7.

After forming the barrier ribs 7, baking is performed simultaneously for barrier ribs 7 and the protection layer 16.

After the barrier ribs 7 are formed, the phosphor layers 9R, 9G, and 9B are formed between the barrier ribs 7 by the use of photosensitive phosphor materials which are printed between the barrier ribs 7, exposed, and developed. At first, a red phosphor material is mixed with a solvent and a photosensitive resin to form a paste. The paste is applied in those regions between two adjacent ones of the barrier ribs 7 by the use of the screen pattern. It is noted here that the red phosphor is not applied to all regions between every two adjacent ones of the barrier ribs 7 but is applied to every third region. The remaining two regions are left for green and blue phosphor materials. After printing, the red phosphor paste is dried to evaporate the solvent. Thus, the phosphor layer 9R is obtained.

Thereafter, in the manner similar to formation of the red phosphor layer, a green phosphor material is mixed with a solvent and a photosensitive resin to form a paste. The paste is printed by the use of a screen pattern to be next to the red phosphor layer 9R already formed. After printing, the green phosphor paste is dried to evaporate the solvent. Thus, the phosphor layer 9G is obtained.

Finally, the blue phosphor layer 9B is formed. The formation is similar to those mentioned in conjunction with the red and the green phosphor layers 9R and 9G and will not be described any longer.

After printing, the red, the green, and the blue phosphor layers 9R, 9G, and 9B are subjected to exposure and development. An exposure mask has a black pattern corresponding to the barrier ribs 7 and the protection layer 16. Therefore, those portions of the phosphor layers 9R, 9G, and 9B which are formed on the protection layer 16 and on the barrier ribs 7 are not exposed. As a result, these unexposed portions are removed upon development. After the development, baking is performed to form the phosphor layers 9R, 9G, and 9B.

The front substrate 1 and the rear substrate 10 are bonded to each other in the manner such that the X electrodes 12 and the Y electrodes 15 perpendicularly intersect with each other and that the color filter layers 4R, 4G, and 4B formed on the front substrate 1 transmit luminescent colors of the phosphor layers 9R, 9G, and 9B formed on the rear substrate 10, respectively. Then, a dischargeable gas is confined in a cavity defined between the front and the rear substrates 1 and 10 to complete the color PDP.

When the color PDP thus produced is driven, no open circuit occurs in the X electrodes 12. This is because the color filter layers 4R, 4G, and 4B are formed between the transparent dielectric layers 5*a* and 5*b*. In addition, the driving voltage is stable throughout an entire surface of the PDP and high contrast and high color fidelity can be obtained.

In this embodiment, the color filter layers 4R, 4G, and 4B are formed within the transparent dielectric layers 5*a* and 5*b*. Even if the color filter layers 4R, 4G, and 4B are formed on the front substrate 1, no open circuit of the X electrodes 12 occurs. This is because the color filter layers 4R, 4G, and 4B are not brought into contact with the X electrodes 12 and the X electrodes 12 are formed on the substrate without the transparent electrodes under the X electrodes 12. In addition, the driving voltage is stable throughout an entire surface of the PDP and high contrast and high color fidelity can be obtained.

Figure 4:
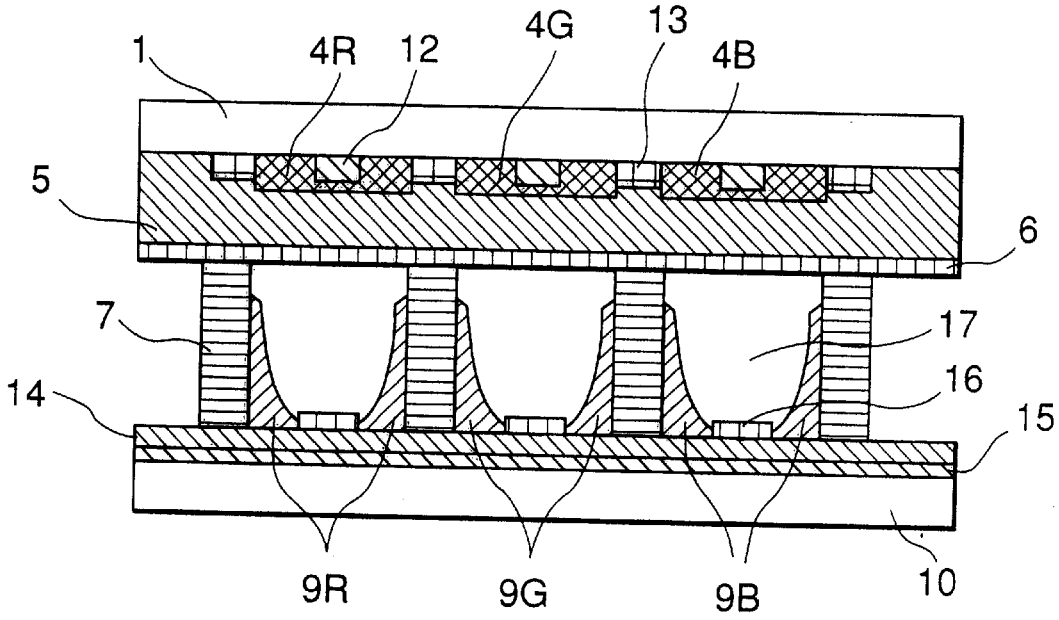
FIG. 4 PRIOR ART
FIG. 4 is a sectional view of a conventional reflection AC type opposed discharge color plasma display panel.
Figure 5:
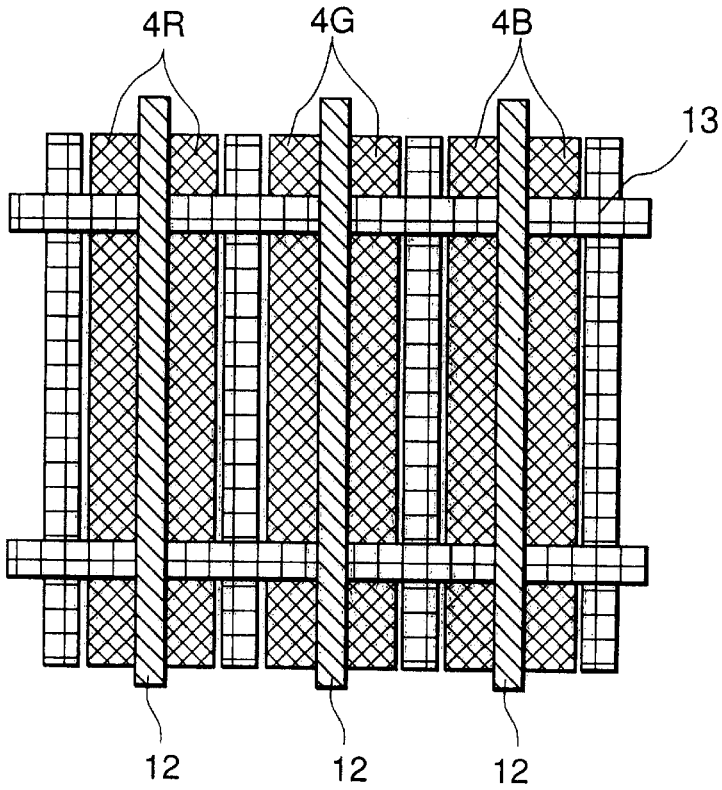
FIG. 5 PRIOR ART
FIG. 5 is a view for use in describing a location relationship between color filter layers and X electrodes of the panel of FIG. 4 when the panel is seen from an upper side of FIG. 4.
Figure 6:
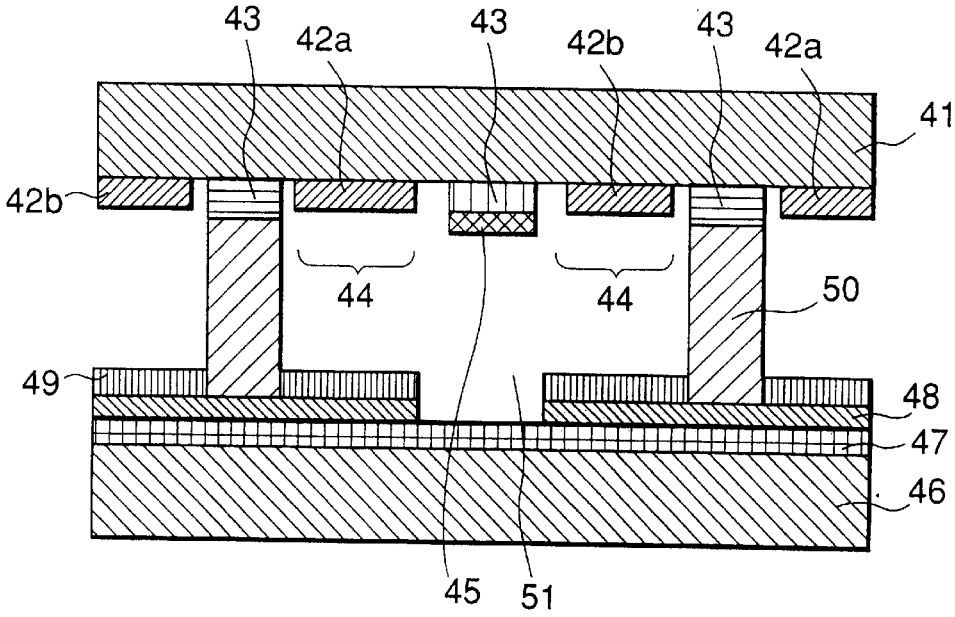
FIG. 6 PRIOR ART
FIG. 6 is a sectional view of a conventional DC type color plasma display panel with color filters.

Summarizing in FIGS. 11 and 12, an AC type opposed discharge color plasma display panel according to the third embodiment of this invention includes: a first substrate (1) having a first substrate surface; first, second, and third X electrodes (12) which are formed on the first substrate surface and are substantially parallel to each other; first, second, and third color filter layers (4R, 4G, and 4B) which are formed in correspondence to the first, the second, and the third X electrodes and are transparent to red light, green light, and blue light, respectively; a transparent dielectric layer (5) covering the X electrodes and the color filter layers; a second substrate (10) having a second substrate surface opposite to the first substrate surface; a plurality of Y electrodes (15) formed on the second substrate surface and perpendicular to the X electrodes; a dielectric layer (14) covering the Y electrodes; first, second, and third phosphor layers (9R, 9G, and 9B) formed on the dielectric layer; and barrier ribs (7) defining first, second, and third discharge spaces (17 of FIG. 4) between the first, the second, and the third phosphor layers and the first, the second, and the third color filter layers. The first, the second, and the third phosphor layers are excited by ultraviolet rays produced by gas discharge in the first, the second, and the third discharge spaces to emit red light, green light, and blue light, respectively.

In the AC type opposed discharge color plasma display panel, the first, the second, and the third color filter layers extend in parallel to the first, the second, and the third X electrodes and are located offset from the first, the second, and the third X electrodes on the first substrate surface so as not to overlap the first, the second, and the third X electrodes and so as not to be brought into contact with the first, the second, and the third X electrodes.

In the AC type opposed discharge color plasma display panel, the color filter layers are formed inside of the transparent dielectric layer (5*a* and 5*b*), Alternatively, the color filter layers may be formed on the first substrate surface of the first substrate.

As described above, in the color PDP of this invention, whether the surface discharge AC type or the opposed discharge AC type, the color filter layers are not brought into contact with the bus electrodes or the X electrodes. Therefore, no floating of the bus electrodes or the X electrodes occurs during baking of the transparent dielectric layer. As a result, when the PDP is formed, it is possible to suppress occurrence of open circuits and insufficient dielectric strength.

Whether the color filter layers are formed to be coplanar with the bus electrodes or the X electrodes or formed inside the transparent dielectric layer, the transparent dielectric layer and the protection layer alone exist on the bus electrodes. As a result, the electric charges stored at the surface of the transparent dielectric layer on the bus electrodes or the X electrodes do not depend upon the materials of the color filter layers. It is therefore possible to avoid nonuniformity in voltage due to presence of the red, the green, the blue transparent color filter layers. Thus, the discharge voltage is stable throughout an entire panel area.

What is claimed is:

1. An AC type surface discharge color plasma display panel comprising: a first substrate (1) having a first substrate surface; a pair of surface discharge electrode sets (2H) each of which comprises a transparent electrode (2) formed on said first substrate surface and a bus electrode (3) formed on a part of said transparent electrode, said transparent electrodes being substantially parallel to each other, said bus electrodes being substantially parallel to each other and to said transparent electrodes; first, second, and third color filter layers (4R, 4G, and 4B) perpendicularly intersecting with said surface discharge electrode sets and transparent to red light, green light, and blue light, respectively; a transparent dielectric layer (5) covering said surface discharge electrode sets and said color filter layers; a second substrate (10) having a second substrate surface opposite to said first substrate surface; first, second, and third data electrodes (8) formed on said second substrate surface in correspondence to said first, said second, and said third color filter layers; first, second, and third phosphor layers (9R, 9G, and 9B) formed on said first, said second, and said third data electrodes, respectively; and barrier ribs (7) defining first, second, and third discharge spaces (11) between said first, said second, and said third phosphor layers and said first, said second, and said third color filter layers; said first, said second, and said third phosphor layers being excited by ultraviolet rays produced by gas discharge in said first, said second, and said third discharge spaces to emit red light, green light, and blue light, respectively, wherein:

each of said first, said second, and said third color filter layers and each of said bus electrodes are located offset from each other on said first substrate surface so as not to overlap each other and so as not to be brought into contact with each other.

2. An AC type surface discharge color plasma display panel as claimed in claim 1, wherein said color filter layers are brought into contact with said transparent electrodes and said first substrate.

3. An AC type surface discharge color plasma display panel as claimed in claim 1, wherein said color filter layers are formed inside of said transparent dielectric layer (5*a* and 5*b*).

4. An AC type opposed discharge color plasma display panel comprising: a first substrate (1) having a first substrate surface; first, second, and third X electrodes (12) which are formed on said first substrate surface and are substantially parallel to each other; first, second, and third color filter layers (4R, 4G, and 4B) which are formed in correspondence to said first, said second, and said third X electrodes and are transparent to red light, green light, and blue light, respectively; a transparent dielectric layer (5) covering said X electrodes and said color filter layers; a second substrate (10) having a second substrate surface opposite to said first substrate surface; a plurality of Y electrodes (15) formed on said second substrate surface and perpendicular to said X electrodes; a dielectric layer (14) covering said Y electrodes; first, second, and third phosphor layers (9R, 9G, and 9B) formed on said dielectric layer; and barrier ribs (7) defining first, second, and third discharge spaces (17) between said first, said second, and said third phosphor layers and said first, said second, and said third color filter layers; said first, said second, and said third phosphor layers being excited by ultraviolet rays produced by gas discharge in said first, said second, and said third discharge spaces to emit red light, green light, and blue light, respectively; wherein:

said first, said second, and said third color filter layers extends in parallel to said first, said second, and said third X electrodes and are located offset from said first, said second, and said third X electrodes on said first substrate surface so as not to overlap said first, said second, and said third X electrodes and so as not to be brought into contact with said first, said second, and said third X electrodes.

5. An AC type opposed discharge color plasma display panel as claimed in claim 4, wherein said color filter layers are formed on said first substrate.

6. An AC type opposed discharge color plasma display panel as claimed in claim 4, wherein said color filter layers are formed inside of said transparent dielectric layer (5*a* and 5*b*).

7. An AC type opposed discharge color plasma display panel as claimed in claim 4, wherein each of said first, said second, and said third color filter layers is a pair of color filter layers on both sides of each of said first, said second, and said third X electrodes.

* * * * *

UNITED STATES PATENT AND TRADEMARK OFFICE

CERTIFICATE OF CORRECTION

PATENT NO. : 6,232,717 B1
DATED : May 15, 2001
INVENTOR(S) : Oida et al.

It is certified that error appears in the above-identified patent and that said Letters Patent is hereby corrected as shown below:

Title page,
Insert at -- [30] Foreign Application Priority Data
November 17, 1997 [JP] Japan.....9-314771 --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*